US005090929A

United States Patent [19]

Rieben

[11] Patent Number: 5,090,929

[45] Date of Patent: Feb. 25, 1992

[54] PAIRED MOTOR SYSTEM FOR SMALL BOAT PROPULSION AND STEERAGE

[76] Inventor: Leo R. Rieben, S. 3205 University, No. 10, Spokane, Wash. 99206

[21] Appl. No.: 684,694

[22] Filed: Apr. 12, 1991

[51] Int. Cl.[5] ..... B63H 11/107

[52] U.S. Cl. ..... 440/40; 114/151

[58] Field of Search ..... 114/151; 440/38, 40; 60/221, 222

[56] References Cited

U.S. PATENT DOCUMENTS

| | | | |
|---|---|---|---|
| 1,843,574 | 2/1932 | May | 440/40 |
| 2,145,493 | 1/1939 | Norquist | 114/151 |
| 3,675,611 | 7/1972 | Glass . | |
| 3,797,447 | 3/1974 | Stubblefield | 114/151 |
| 3,865,067 | 2/1975 | Archer | 114/151 |
| 4,138,963 | 2/1970 | Thompson | 114/151 |
| 4,265,192 | 5/1981 | Dunn | 114/151 |
| 4,747,359 | 5/1988 | Ueno | 114/144 B |
| 4,767,364 | 8/1988 | Lenz | 440/38 |
| 4,807,552 | 2/1989 | Fowler | 114/151 |

*Primary Examiner*—Jesus D. Sotelo

*Attorney, Agent, or Firm*—Keith S. Bergman

[57] ABSTRACT

Paired spaced electrically driven motors provide a steerable propelling system for small boats. Each motor drives a propeller carried in an elongate channel, communicating from each lateral side of a boat beneath the water line to one boat end, to move water through such channels for boat propulsion. The electrical motors are of variable speed, reversible, and separately controlled by a joystick type control device to provide differential control of motor speed to allow steerage. The propelling system provides a low speed, maneuverable propulsion system for fishing use, as an auxiliary power system for boats having a separate principal powering system, and to aid maneuverability alone or in conjunction with the principal powering system.

9 Claims, 3 Drawing Sheets

FIG 1
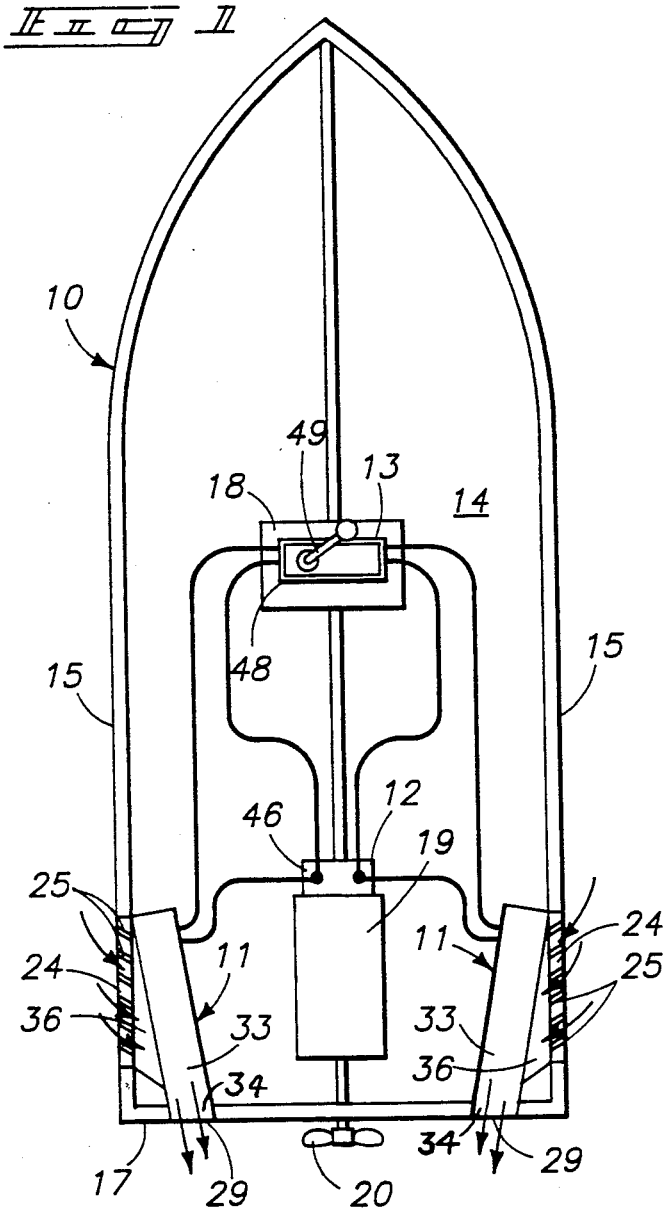
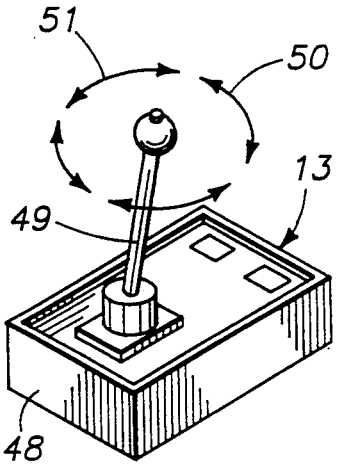
FIG 6
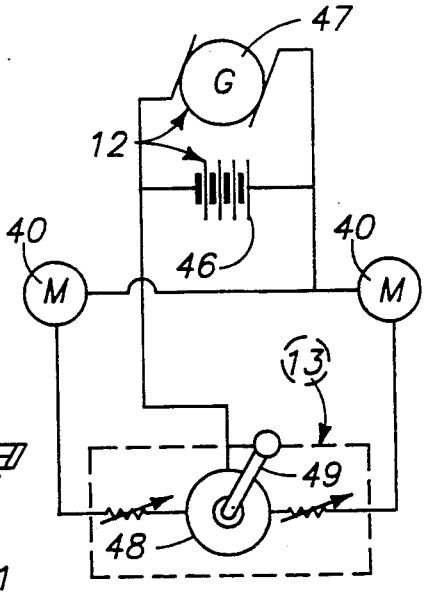
FIG 7
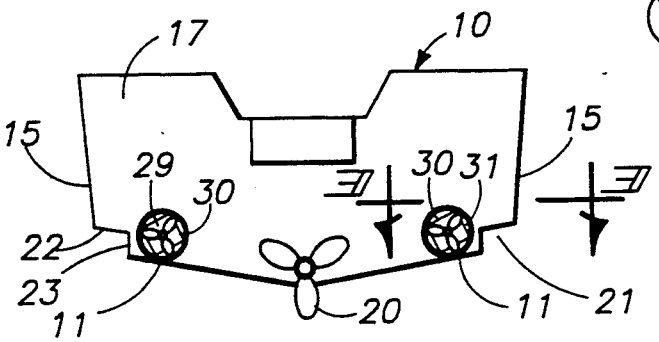
FIG 2

PAIRED MOTOR SYSTEM FOR SMALL BOAT PROPULSION AND STEERAGE

BACKGROUND OF INVENTION

Related Applications

There are no applications related hereto heretofore filed in this or any foreign country.

FIELD OF INVENTION

This invention relates generally to propulsion and steerage of small boats, and more particularly to a system having paired individually controlled motors that move water through laterally spaced channels defined in a boat from medial intake portions to exhaust orifices at one boat end.

DESCRIPTION OF PRIOR ART

As the development of small boats and their propulsion has progressed, such craft have tended to be powered by larger motors, until in the present day the size of such motors commonly ranges upwardly of one hundred horse power. Such larger power sources make difficult some boat operations such as docking and accurate maneuvering, and they make very difficult, if not impossible, various boat uses such as in fishing. Responsive to this problem, various smaller auxiliary powering systems for such boats, especially in a size range of lengths from twelve to twenty feet, have become known for use where lower power, slower speed and higher maneuverability are desirable or necessary. The instant invention provides a new and novel member of this class of auxiliary powering systems.

Most prior auxiliary powering systems have provided a single secondary self-contained auxiliary motor that is totally independent of a boat's principal powering system and commonly such auxiliary motors have taken the form of an outboard type motor releasably positioned on or in the vicinity of the stern of a serviced boat. Such auxiliary outboard motors have various drawbacks and inherent problems. These motors are difficult to mount, often requiring specialized ancillary support structures to allow mounting in an operative position, and when mounted, they often are cumbersome, interfere with normal boat handling and operation, and present an unsightly appearance.

Outboard type auxiliary motors are often difficult to steer, especially from positions remote from the motor. It generally is desired that an auxiliary motor be controlled by an existing steerage system associated with the principal boat motor and if this association can be accomplished, it often may be accomplished only with significant difficulty, complex interconnecting mechanism and substantial cost. Such auxiliary motors have been powered completely separately and independently from the principal boat powering system and commonly, in the present day environmentally sensitive atmosphere, have been powered by electricity derived from a storage battery. This electrical powering requires frequent charging of commonly small storage batteries associated with most auxiliary electric motors for powering.

The common outboard type auxiliary motors have also generally been of traditional motor configuration providing a depending shaft carrying an exposed propeller at its lower portion. This structure positions the propeller in an exposed area where it may be damaged by debris in the surrounding water. Such construction presents a particular problem in the case of small fishing boats as they commonly operate in shallow waters that are often filled with vegetation or other debris.

My invention solves these problems by providing a steerable auxiliary powering system having similar opposed, motor carrying propulsion channels extending on each side of the medial line of a boat between orifices defined below the water line in the medial portion of a boat hull to output orifices defined in the boat stern or bow. This structure does away with problems associated with mounting of auxiliary outboard type powering structures externally of a boat hull. The structure also allows convenient carriage in an ordinary boat because the propulsion channels generally may be below the floor level of most boats having floors and otherwise may be located immediately upwardly adjacent the boat bottom or positioned partially or completely on the outer surface of a boat hull.

My powering system solves the problem of boat steerage by providing electric motors driving associated propellers in each laterally spaced motor channel that are operated responsively to motion of a single joystick controller which determines speed of each motor. The joystick controller may be positioned as desired within the boat being serviced. The electric motors provide simple means for reversal of propeller motion so that the propellers may operate to move the boat either forwardly or rearwardly with substantially the same steerage control in either direction.

Power supply problems are alleviated by providing an electrical system powered by a rechargeable storage battery that is removable for recharging, and also interconnected with a generator system of the principal powering source for a serviced boat so that electrical power may be provided or replenished by operation of the principal motor. Most primary boat powering systems provide some type of a power train between motor and propeller to allow motor operation without propeller operation, so that the principal motor may be used as a power source for operation of my auxiliary system without boat propulsion by the principal system.

The problem of propeller protection in my propulsion system is substantially non-existent by reason of the structure of the system itself, since the rotating propellers are carried in protective channels. Grills and auxiliary screens are provided at channel orifices to prevent smaller debris from entering and passing through the propulsion channels, and any damage from physical contact with external objects is totally eliminated by the complete enclosure of the propellers.

Various propulsion systems for water craft that provide one or more channels through which water is moved by rotating propeller-like devices have heretofore become known, both as primary propelling systems and for various auxiliary purposes. My propulsion system differs from this prior art by providing laterally spaced propulsion channels having orifices defined in a boat hull beneath the water line to provide no external structures that materially interfere with normal boat operation by a primary powering source. The output orifices are defined in lateral positions beneath the normal water line to provide maximum steerage and thrust. The propelling channels may be beneath ordinary boat floorboards where they do not interfere with use of the boat interior, and if not, they are in a position where there is minimal interference with boat use.

My system is also designed to use existing motors and propellers of present day commercially available electric outboard motors so that these structures need not be specially constructed. My system may be installed in existing boats merely by establishing the input and output orifices in a boat hull, or it may be established during boat construction as part of the overall boat structure by molding from common present day boat materials.

My invention lies not in anyone of these features per se. but rather in the synergistic combination of all of the structures of my propulsion system that gives rise to the functions necessarily flowing therefrom, as specified and claimed.

SUMMARY OF INVENTION

The instant invention provides a steerable powering system for use in boats. The powering system provides two similar spaced propulsion channels extending in generally elongate array, each channel having a medial input orifice and an endward output orifice communicating below the water line of a serviced boat. The propulsion channels each carry propellers powered by electrical motors to force water in either direction through the channel to cause boat propulsion. Electrically operated control means allow selective and differential speed control of each motor in either rotational direction to allow propulsion and steerage of a boat in either forward or rearward directions. The electric motors arc powered by a rechargeable storage battery which may be interconnected with a generator of a principal boat powering system to allow recharging or to provide complete operating power from the principal system. A control system provides a single joystick type control which may be operated at a distance from the auxiliary motors.

In providing such a system, it is:

A principal object to create a steerable powering system for small boats to propel a serviced boat at lower speeds and with substantial maneuverability A further object is to provide such a system that has paired laterally spaced propelling channels defined in bow or stern portions of a boat being serviced, with orifices in the medial portion of a boat and at one or the other boat end, all orifices being below the normal water line for operative efficiency and minimum interference with boat structures and use.

A further object is to provide such a system, that is controlled by a joystick positioned at a distance from the propulsion system to provide differential motor speeds and motor reversal in both propulsion channels for steerability and propulsion in either a forward or rearward direction.

A further object is to provide such a propulsion system that is powered by a storage battery which may be interconnected to an electrical generator of a principal powering system of a serviced boat to allow recharging or to allow operation of the auxiliary system directly from the primary powering system.

A still further object is to provide such a propulsion system that has no structures to interfere with normal boat operation and one which provides encasement of propellers to avoid injury thereto or damage therefrom.

A still further object is to provide such a propulsion system that may be installed in existing boat structures or may be created during the boat manufacturing process.

A still further object is to provide such a propulsion system that is of new and novel design, of rugged and durable nature, of simple and economic manufacture and one otherwise well adapted to the uses and purposes for which it is intended.

Other and further objects of my invention will appear from the following specification and accompanying drawings which form a part hereof. In carrying out the objects of my invention, however, it is to be remembered that its accidental features are susceptible of change in design and structural arrangement, with only one preferred and practical embodiment of the best known mode being illustrated and specified, as is required.

BRIEF DESCRIPTION OF DRAWINGS

In the accompanying drawings which form a part hereof and wherein like numbers of reference refer to similar parts throughout:

FIG. 1 is an orthographic top view of a boat showing various elements of my invention, their configuration, relationship and positioning within the boat structure.

FIG. 2 is an orthographic rear view of the the boat illustrated in FIG. 1.

FIG. 6 is an isometric view of a joy stick-type control that regulates speed and rotational direction of the motors of my system.

FIG. 7 is a diagrammatic illustration of the electric circuitry of my invention shown n normal symbology.

DESCRIPTION OF THE PREFERRED EMBODIMENT

Figure 3:
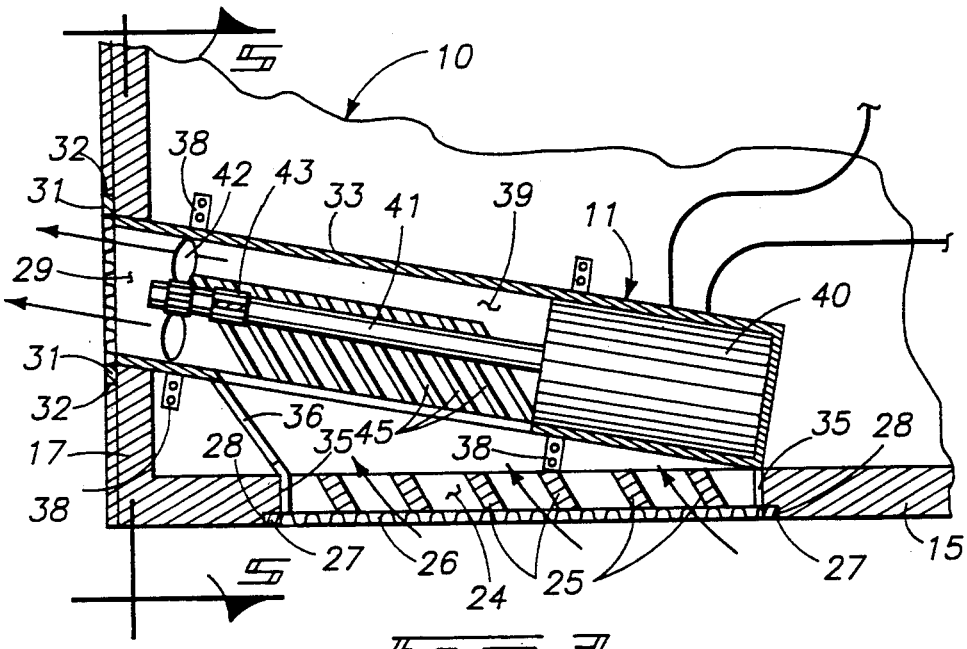
FIG. 3 is an enlarged, partial horizontal cross-sectional view through one of my propulsion channels, taken on the line 3—3 on FIG. 2 in the direction indicated by the arrows thereon.
Figure 4:
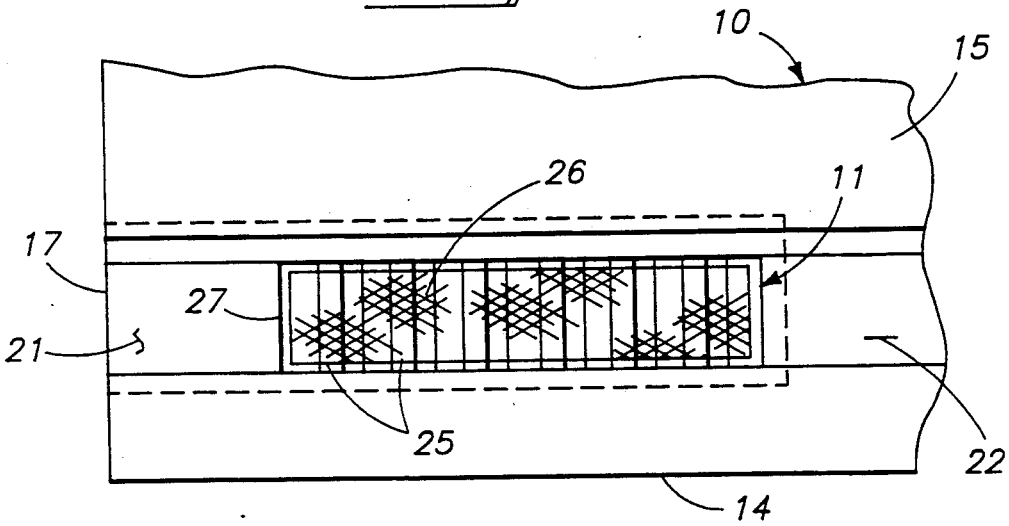
FIG. 4 is an enlarged, orthographic side view of the orifice defined in the boat side with a shutter type grating structure therein.
Figure 5:
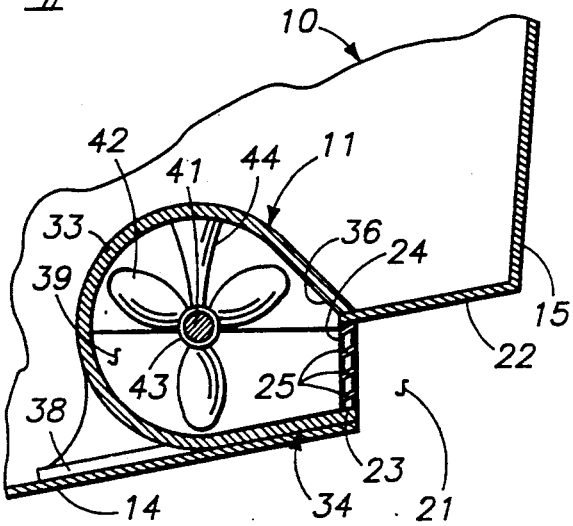
FIG. 5 is a vertical cross-sectional view through the powering channel of FIG. 3, taken on the line 5—5 thereon in the direction indicated by the arrows.

My invention generally provides a steerable propulsion system for boat 10 comprising paired propulsion components 11 operated by powering components 12 and regulated by control component 13.

A typical small boat 10 embodying the first species of my propulsion system is illustrated in FIGS. 1 and 2 of the drawings. The boat 10 provides bottom 14 supporting upstanding, curvilinear sides 15 which join in their forward portions to form bow 16 and in their rearward portion structurally interconnect upstanding stern 17 to form a boat hull structure. The boat provides medial control pillar 18 carrying steerage mechanism and is powered by inboard type primary motor 19 powering propeller 20 carried spacedly rearwardly of the lower medial portion of the stern 17 in traditional fashion.

The bottom of such boat hull is commonly formed so as to define paired opposed lateral channels 21 extending forwardly and rearwardly along the lower portion of each side of the boat as defined by somewhat horizontal surface 22 and somewhat vertical surface 23. The exact configuration of this lateral channel structure varies with different boat types, but most modern boats generally provide at least the essence of the structure.

One orifice 24 for the first species of my propulsion system is defined in each vertical surface 23 of the lateral channels, spacedly forwardly of stern 17. These orifices 24 are input orifices for normal forward propulsion of a boat and will therefore for convenience be referred to as the forward input orifice, though with rearward motion of the boat the orifice would physically be an output orifice. This forward orifice is provided with vertically extending louvers 25, and its outer surface is preferably covered by screen 26 carried in peripheral frame 27 which is releasably fastened in screen groove 28 defined about at least part of the outer periphery of boat side 15 defining the forward orifice. Louvers 25 commonly are fixedly positioned in the forward orifice, as illustrated, though if desired the louvers may be pivotally mounted in the boat side structure defining that orifice so that they may be selectively pivotally movable to determine the direction of flow of water through the forward orifice. With normal small boat propulsion systems, however, the sophistication of movable louvers is not necessary nor particularly desirable. On larger boat structures, it may be beneficial.

Second rearward orifices 29 are defined in the stern 17 of a boat to be serviced to receive the rearward portions of the propulsion system body channels therein. These orifices 29 again for convenience of reference will be referred to as the rearward or output orifices, though during rearward motion of a boat the orifices physically are input orifices. One such rearward orifice is defined in each lateral portion of the stern, at as low a level as possible so that the orifice will be below the surface of water supporting boat 10. The rearward orifices may be defined so that casements carried therein are angulated or parallel to each other and to the boat keel, but whatever the array, pair casements should be symmetrical about the keel to aid and simplify steerage.

The rearward orifices preferably are covered by screen 30 carried in peripheral frames 31 to allow relatively free passage of water, but prevent the entry of debris through the orifices. Peripheral frames 31 are fastenably carried in grooves 32 defined by the outer surface of the stern forming the periphery of the orifice to allow releasable fastening of the frames.

Propulsion components 11 provide similar paired casements each providing cylindrical tubular bodies 33 structurally interconnecting similar transition elements each having orifice portion 35, with a peripheral configuration to fit immediately inwardly adjacent the portion of a boat side defining the periphery of forward orifice 24, and transition portion 36 extending from the orifice portion into structural communication with forward body orifice 37. The rearward portion 34 of each tubular body 33 is of such configuration as to fit immediately inwardly adjacent a rearward orifice 29 defined in stern 17 of a serviced boat. Both orifice portion 35 of the transition element and rearward portion 34 of the tubular body are structurally secured with water-tight seals in the respective orifices in which they are carried. Normally this fastening is sufficient to maintain the propulsion system casements in proper position in a boat structure, but if necessary or desired, additional fastening brackets 38 may be provided to extend between the cylindrical body 33 and adjacent boat surfaces to more securely structurally interconnect these elements.

Each tubular body 33 defines internal channel 39 which carries in its forward portion electric motor 40, with propeller shaft 41 extending a spaced distance rearwardly therefrom to carry propeller 42 at a position spacedly forwardly of rear orifice 29 and rearwardly of body orifice 37. Propeller shaft 41 may be supported between the motor and propeller by bearing 43 structurally carried by pillar 44 which is in turn supported by the internal surface of tubular body 33. If desired, the rearward portion of shaft 41 may extend into bearing communication with screen element 43 to be further supported thereby (not shown), but this is not necessary.

Body and transition elements 33, 36 are formed of some rigid, durable material of appropriate strength, commonly a lighter metal, though they may also be formed from some of the harder, more dense polymeric or resinous plastic materials. The channel 39 defined in tubular body 33 may be provided with plural, spaced veins 45 angulated to the axis of shaft 41 to aid the directing of water flow through the forward part of that channel, though this structure is optional and not necessary to the operation of my invention. If veins 45 are used, one or more of the veins might also be so configured as to carry bearing 43 to provide support for shaft 41.

Powering component 12 provides rechargeable storage battery 46 communicating in a parallel electrical communication with generator 47 of primary propulsion system 19. Storage battery 46 preferably is of a marine type and is so supported that it may be removable for recharging from an external separate power source. Storage battery 46 may even comprise the storage battery of the principal propulsion system of a boat, though commonly it is desirable to have a separate battery for that system and for my propulsion system, as many batteries of primary propulsion systems may not be large enough to store enough electrical energy for usage in both propulsion systems.

Control component 13 provides joystick type control 48 having control rod 49 movable in a first direction to vary the amount of current passing to one motor of my system relative to the current passing to the other motor, and movable in a second perpendicular direction to regulate the total amount of current passing through the control device to both motors. By passing over a medial position in the second motion direction the control regulates the polarity of the powering current to determine the direction of rotation of the motors of my system. Such circuitry is known in various model vehicle applications and electrical components in those known devices may be adapted for use in my control system. Because of this prior knowledge, the structure of the joystick control 48 is not set forth in detail. The circuitry embodying the control is set forth in essence in the schematic electrical diagram of FIG. 7 from which the foregoing operation may be readily understood.

A second species of my invention is shown in the illustrations of FIGS. 8 through 13. This second species differs in providing both a forward and a rearward propulsion system, in providing the medially positioned propulsion orifices in a boat bottom portion rather than in side portions, and in providing a particular type of propulsion component.

Figure 8:
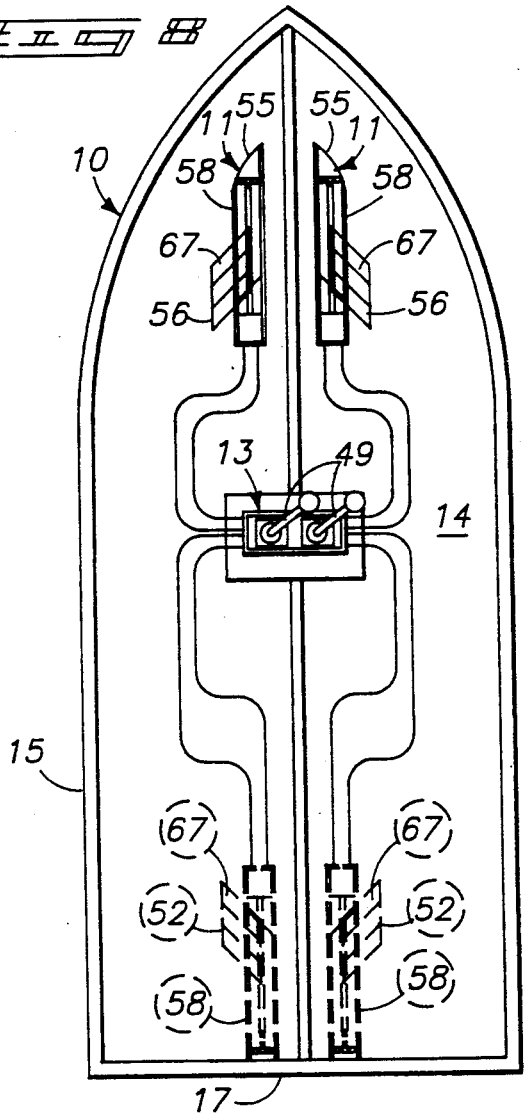
FIG. 8 is an orthographic top view of a boat embodying species of my invention with propulsion systems in both the front and back of a boat.
Figure 10:
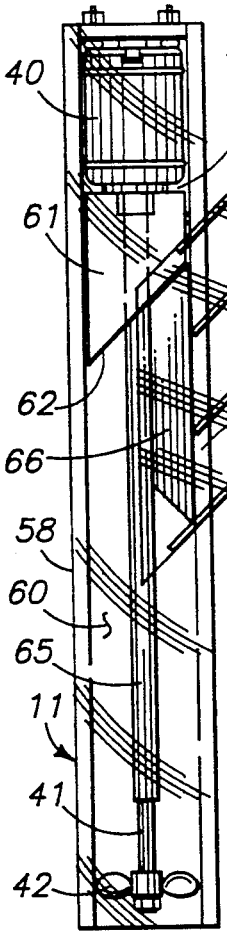
FIG. 10 is an orthographic top view of the propulsion tube structure of FIG. 8.
Figure 12:
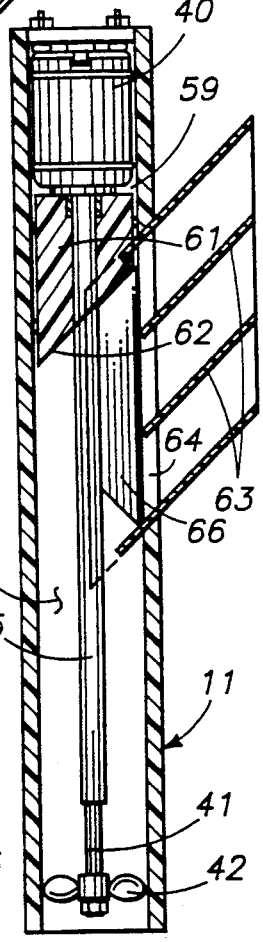
FIG. 12 is a horizontal cross-sectional view of the propulsion tube structure of FIG. 11, taken on the line 12—12 thereon in the direction indicated by the arrows.
Figure 9:
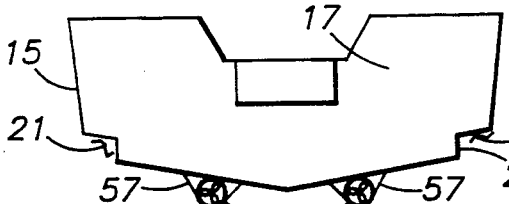
FIG. 9 is an orthographic rear view of the boat illustrated in FIG. 8.
Figure 13:
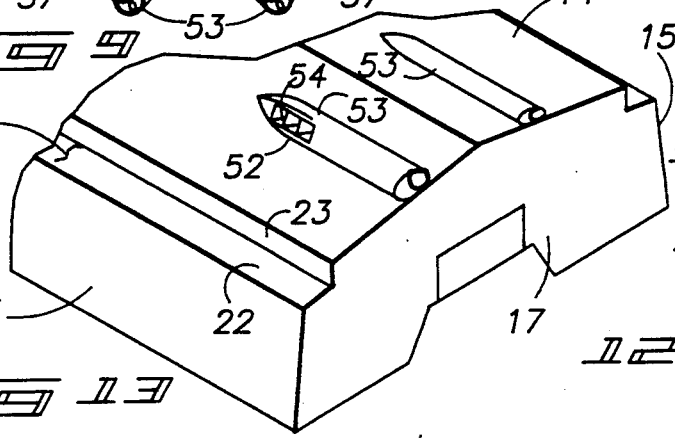
FIG. 13 is a partial isometric view of the stern and bottom portions of the boat of FIG. 8 showing propulsion channels on the exterior surface of a boat hull.
Figure 11:
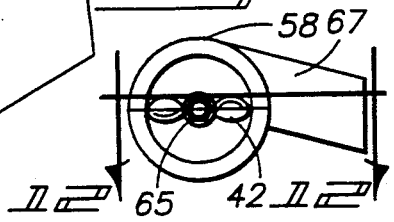
FIG. 11 is an orthographic end view of the propulsion tube structure of FIG. 10.

As seen in FIGS. 8, 9 and 13, the rear propulsion components are carried on the external surface of the bottom 14 of the boat hull. The tubular bodies 58 and transition elements 67 are covered on their under surface distal from the boat bottom by elongate peripherally defined protective pods 53 having orifices 54 through which water passes into the orifices of transition elements 67. The pods 53 may comprise ordinary strake structures that are commonly a part of many smaller boats, if those strakes are of sufficient size. If separate pods are added to the boat structure, they are formed and structurally attached to a boat hull like ordinary strakes, and in fact would also serve the same purposes as strakes. The rear orifices of this system are defined in the rear portion of each pod. In the instance illustrated the pods and contained propulsion component bodies are axially parallel and parallel to the boat keel, but angulated positioning of these structures as in the first specifies is within the scope of my invention.

The forward propulsion system is carried on the inside surface of the forward portion of the boat hull. This forward system provides spaced propulsion components similar to those same structures of the rearward propulsion system, except that they are reversed in forward and rearward orientation with transition elements 67 being rearwardly. One end portion of each tubular body 58 is carried in spaced holes 55 defined in lower bow portion of boat 10 beneath the normal water line. The rearwardly transition elements extend laterally to communicate with spaced holes 56 defined in the boat bottom. In the instance illustrated the holes are so defined that the opposed tubular bodies are parallel, but those bodies may be angulated and remain within the scope of my invention. The orifices 55, 56 are protected by screens (not illustrated) as in the first species of my invention to prevent the passage of debris therethrough and may be protected by pod covers (not shown).

The forward and rearward propulsion systems are controlled by separate controllers 48, each controller being of the same nature as in the first species of my invention. The controllers 48 are so related to each other that when the control rods 49 of each controller are in the same position they will cause each propulsion system to move water therethrough in the same fashion to provide more easy steerage.

This combination of forward and rearward propulsion systems allows both systems to be used simultaneously or either system to be used separately to accomplish propulsion and steerage. Steerage is somewhat better and more easily accomplished by using both systems simultaneously and when so doing a boat may be moved substantially laterally by appropriate control manipulation. Obviously, if desired, both forward and rearward propulsion systems might be controlled by a single controller (not shown), but such common control makes steerage more complex and less efficient.

The propulsion tubes for either the forward or rearward propulsion systems of the species FIGS. 8–12 are of substantially the same configuration. Each tube 58 is a circular cylinder defining in its medial facing end a motor chamber 59 which is separated from the water carrying portion of channel 60 by plug 61 which has an angulated water directing face 62 most distal from the motor. Plugs 61 are of smaller diameter than channel 60 and are supported therein by columns structurally communicating therebetween to define a channel through which water may move from channel 60 into the motor chamber 59 to aid cooling of a motor carried in that chamber. Face 62 of plug 61 is substantially parallel with louvers 63 carried in the channel defined by angulated transition structure 64 so that both structures aid in creating streamlined flow of water into channel 60. The louvers 63 also provide support for the transition structure 64 to increase the strength and rigidity of that structure and allow it to be formed with an elongate rectilinear shape, as illustrated, which is the preferred shape for that element and especially its external orifice.

Propeller shaft 41 is rotatably carried in elongate support tube 65 and both structures project through an appropriate orifice in plug 61 and into channel 60 of the tubular body to carry a propeller for rotation in channel 60. The support tube 65 is supported by somewhat horizontally orientated support shelf 66 carried by the inner surface of tube 58 at the lower edge of transition structure 64. This species of propulsion tube provides efficient streamlined flow of water into and through tube channel 60 with somewhat of a spiral motion being imparted to water moving through the tube from the angularly related transition structure 64.

Having described the structure of my invention, its operation may be understood.

To use the first species of my invention a propulsion system is formed according to the foregoing specification. For installation in an existing boat structure, forward orifices 24 are created in vertical surface 23 of each side 15 of boat 10, and rearward orifices 29 are defined in appropriate position in stern 17. The two propulsion components 33, 36 are positioned with their orifices in the orifices defined in boat 10 to accommodate them and are structurally fastened in a water-tight fit in such boat orifices. The channels supporting screens 26 and 30 are formed in the peripheral area surrounding the boat orifices and the screens are fastenably positioned in those orifices. Battery 46 and joystick control 48 are electrically interconnected with each other and with the propulsion motors, and both the battery and joystick control are appropriately positioned in the boat structure for use. This installation generally may be accomplished by workmen not having any specialized skills or by an unskilled boat owner.

If the installation is in a new boat structure, the boat may be formed and my propulsion system installed as previously indicated. If desired, however, my system may be placed during the boat formation process so that during that process orifices may be formed in the hull structure for the various element of my invention. In fact if desired, the propulsion system components 33, 36 might be formed integrally with the boat structure by known methods such as are used in the formation of that boat structure itself.

To operate my system, joystick control 48 serves both as a power switch and control device. The control rod 49 is biased to maintain a position once established and must be manipulated in a particular fashion, generally by pressing it inwardly in an axial direction, to allow motion. When the control rod is in a center position the propulsion system will be in an off or inoperative condition. As the propulsion system is activated, control rod 49 is depressed and may be moved in a forward-rearward direction as shown by arrow 51 in FIG. 6 to regulate absolute motor speed and direction of rotation. If the control rod be forwardly of its medial position, motors will be rotated in one direction, while if it is moved rearwardly past that medial position, the motors will be rotated in the opposite direction. The amount of forward or rearward motion of the control lever determines the relative amount of total electric current that is furnished to both motors. If the control rod 49 is moved in a lateral direction, as indicated by arrow 50, the relative amount of current passing to each propulsion motor will be varied with current being passed in proportion to the amount of motion of the control lever from a medial position. Both motors will operate with equal power when the control rod is in a medial position, and the motor on the side away from which the rod is moved laterally will receive proportionately greater current than the other motor responsive to the amount of motion of the control rod in that direction. The direction of boat motion responsive to the direction of control rod motion, however, obviously is not essential to my invention.

The operation of the second species of my invention is essentially the same as the first species. The forward and rearward propulsion systems and installed as specified in appropriate pre-established orifices in a boat hull. For propulsion either or both propulsion systems may be operated in the same fashion as with the first species. With both systems operating their function is substantially the same as the additive combination of each individual system. In the second species, the two propulsion systems may be regulated so that their forward-rearward propulsion components neutralize each other and their lateral components create motion in the same direction, so that a boat may be propelled substantially in a lateral direction only which is useful in boat docking.

It should be particularly noted that in the second species either of the propulsion systems may be operated independently of the other and either system may have parallel or angulated propulsion tube bodies carried either on the inside or outside of a boat hull.

With my control system, a high degree of maneuverability may be obtained in a boat serviced by my propulsion systems when the boat is moving in any direction. With the joystick type control, steerage is rapidly learned and a person of no experience can learn to control and steer a boat embodying my propulsion system in a short period of time from actual experience and without any expert instruction.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what desire to protect by Letters Patent, and what I claim is:

1. A steerable propulsion system for boats comprising, in combination:

two similar propulsion components carried in laterally spaced relationship by a boat, each propulsion component having an elongate cylindrical body defining an internal channel having a first open end communicating with water supporting the carrying boat and a second closed end, said channel carrying inwardly adjacent the second end an electrically powered motor having a propeller shaft extending toward the first end to carry a propeller for rotation within the internal channel to move water through the internal channel responsive to propeller motion, and a peripherally defined transition element structurally carried by the cylindrical body spacedly inward of the second end to extend outwardly therefrom, said transition element defining an internal channel communicating from an external orifice, distal from the elongated cylindrical body and communicating with water supporting the carrying boat, to the internal channel defined in the cylindrical body;

a powering component supplying electric energy to each electric motor, said powering component having power storage means including a rechargeable storage battery; and a control component including control means movable in a first direction to regulate the total current passing to both propulsion motors and the direction of rotation of both motors and movable in a second direction to regulate the relative power passing to each motor to determine speed of propulsion of a serviced boat and allow steerage thereof.

2. The invention of claim 1 further characterized by:

the boat carrying the propulsion system having a second principal powering system including a generator;

the storage battery of said electrical powering component being interconnected in parallel with the generator of the second principal powering system of the serviced boat to recharge said storage battery and allow operation of said powering component directly from electrical energy generated by the principal powering system.

3. The propulsion of claim 1 further characterized by:

the propulsion components being positioned inside a boat with orifices for the transition element orifices defined in a medial forward portion of the boat hull and orifices for the first open ends of the cylindrical bodies defined in the boat stern, all said orifices defined in the boat being substantially below the normal water line and having screen means to prevent the passage of debris therethrough.

4. The propulsion system of claim 1 further characterized by:

the propulsion components being carried inside a boat with orifices for the transition elements defined in a lineally medial portion of the boat hull and orifices for the first open end of the bodies defined in the boat bow, all said boat orifices being substantially below the normal water line of the boat and having screen means to prevent the passage of debris therethrough.

5. The propulsion system of claim 1 further characterized by:

the propulsion component being carried on the outside of a boat hull, below the normal water line of the boat, in peripherally defined protective pods having orifices to allow the first end of the cylindrical body and the external orifice of the transition element to communicate with the water supporting the boat.

6. The propulsion system of claim 1 further characterized by the propulsion component having the transition element being of rectangular cross-sectional configuration and a plurality of spacedly parallel sheet-like vanes extending between the longer sides parallel to the shorter sides, and the propeller shaft being rotatably carried in a support shaft which is structurally supported in the channel defined in the propulsion component by at least one support element communicating between the support shaft and the inner surface of the propulsion component.

7. The propulsion system of claim 6 further characterized by a plug supported in the channel defined by the propulsion component, between the motor and the transition element orifice, said plug defining a channel for water passage between the plug outer surface and the inner surface of the elongate cylindrical body and an angulated face on its surface distal from the motor substantially parallel to the vanes carried in the chamber defined by the transition element.

8. An auxiliary steerable powering system, for a small boat having upstanding sides, a stern and a primary powering system including a driven electric generator, comprising, in combination:

two similar elongate laterally spaced propulsion components each having a tubular body, with first and second ends and defining a medial channel for containment of water flow therethrough, each said tubular body structurally carrying a radially outwardly extending, peripherally defined transition element spacedly inwardly adjacent the first end, said transition element having an orifice and carried in a forward orifice defined on a first lateral side of a boat hull to be serviced, in a position spacedly forwardly of the stern and below the water line, and the second rearward end of said tubular body being carried in an orifice defined in a boat stern, spacedly inwardly of a lateral boat side and below the water line, both said propulsion components defining spaced symmetrically arrayed channels for water flow from the forward boat orifice to the rearward boat orifices, each said tubular body carrying an electric motor in the channel defined in its first end portion, said electric motor having a propeller shaft extending toward the second end to carry a propeller for rotation in the channel defined in each tubular body spacedly inwardly from its second end;

a powering component including electric power storage means for powering each said electric motor, said power storage means including a rechargeable storage battery; and a control component including a joystick control having a control rod movable in a first linear direction to regulate the relative amount of power passing to each electric motor to determine relative motor speeds to allow steerage and movable in a second linear direction to regulate polarity and total electric power passing to both motors to determine speed and the forward and rearward directions of propulsion.

9. The propulsion system of claim 8 further characterized by:

vane means carried in the transition elements to regulate the direction of flow of water through the channels defined in the transition elements and into the channel defined in the associated tubular body, and external orifices of the transition elements and of the tubular bodies having associated screen means to prevent the passage of debris therethrough.

* * * * *